US009932796B2

(12) United States Patent
Walton et al.

(10) Patent No.: US 9,932,796 B2
(45) Date of Patent: Apr. 3, 2018

(54) TOOL CEMENTED IN A WELLBORE CONTAINING A PORT PLUG DISSOLVED BY GALVANIC CORROSION

(71) Applicant: Halliburton Energy Services, Inc., Houston, TX (US)

(72) Inventors: Zachary W. Walton, Carrollton, TX (US); Michael L. Fripp, Carrollton, TX (US); Zachary R. Murphree, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/655,040

(22) PCT Filed: Jun. 23, 2014

(86) PCT No.: PCT/US2014/043692
§ 371 (c)(1),
(2) Date: Jun. 23, 2015

(87) PCT Pub. No.: WO2015/199647
PCT Pub. Date: Dec. 30, 2015

(65) Prior Publication Data

US 2017/0284169 A1 Oct. 5, 2017

(51) Int. Cl.
*E21B 33/14* (2006.01)
*E21B 34/06* (2006.01)
(Continued)

(52) U.S. Cl.
CPC ..... *E21B 34/063* (2013.01); *C25F 5/00* (2013.01); *E21B 33/12* (2013.01); *E21B 33/13* (2013.01);
(Continued)

(58) Field of Classification Search
CPC ..... E21B 34/063; E21B 33/14; E21B 43/26; E21B 43/25; E21B 2034/007
(Continued)

(56) References Cited

U.S. PATENT DOCUMENTS

| | | | | |
|---|---|---|---|---|
| 3,744,664 | A * | 7/1973 | George | B65D 7/00 220/619 |
| 4,157,732 | A | 6/1979 | Fonner | |
| 6,237,688 | B1 | 5/2001 | Burleson et al. | |
| 8,215,411 | B2 | 7/2012 | Flores et al. | |
| 2004/0188090 | A1 * | 9/2004 | Vaeth | C04B 28/02 166/286 |

(Continued)

FOREIGN PATENT DOCUMENTS

| | | | |
|---|---|---|---|
| EP | 1394133 | A2 | 3/2004 |
| WO | 2011109616 | A2 | 9/2011 |
| WO | 2015156827 | A1 | 10/2015 |

OTHER PUBLICATIONS

Canadian Office Action dated Apr. 26, 2017; Canadian Application No. 2,939,946.

(Continued)

*Primary Examiner* — Taras P Bemko
(74) *Attorney, Agent, or Firm* — McGuireWoods LLP

(57) ABSTRACT

A method of performing an operation in a wellbore is provided. The method includes introducing a tool into the wellbore. The tool comprises a mandrel comprising a port; and a plug located within the port. The plug comprises at least a first material that partially or wholly dissolves via corrosion. The method further includes introducing a cement composition into an annulus located between the outside of the tool at least at the location of the port and the inside of the wellbore, and causing or allowing at least a portion of the first material to dissolve. The step of causing or allowing is performed after the step of introducing the cement composition.

20 Claims, 2 Drawing Sheets

(51) Int. Cl.

| | |
|---|---|
| ***E21B 33/12*** | (2006.01) |
| ***E21B 33/13*** | (2006.01) |
| ***C25F 5/00*** | (2006.01) |
| ***E21B 43/26*** | (2006.01) |
| *E21B 34/00* | (2006.01) |
| *C22C 21/00* | (2006.01) |
| *E21B 43/25* | (2006.01) |

(52) U.S. Cl.
CPC ..... *E21B 33/14* (2013.01); *E21B 43/26* (2013.01); *C22C 21/00* (2013.01); *E21B 43/25* (2013.01); *E21B 2034/007* (2013.01)

(58) Field of Classification Search
USPC ..... 166/285
See application file for complete search history.

(56) References Cited

U.S. PATENT DOCUMENTS

| | | | |
|---|---|---|---|
| 2008/0135249 | A1 | 6/2008 | Fripp et al. |
| 2010/0270031 | A1 | 10/2010 | Patel |
| 2011/0079390 | A1 | 4/2011 | Themig |
| 2013/0126159 | A1 | 5/2013 | Bryan et al. |
| 2013/0327540 | A1 | 12/2013 | Hamid et al. |

OTHER PUBLICATIONS

International Search Report and Written Opinion dated Mar. 23, 2015; PCT International Application No. PCT/US14/043692.
Extended European Search Report dated Oct. 10, 2017; European Patent Application No. 14896265.7.

* cited by examiner

TOOL CEMENTED IN A WELLBORE CONTAINING A PORT PLUG DISSOLVED BY GALVANIC CORROSION

TECHNICAL FIELD

Port plugs are used to temporarily seal a port of a tool. The tool can be cemented inside of a wellbore. The port plugs can be removed after it is desirable to open the port and flow a fluid through the port. A port plug can be removed by dissolving the plug via galvanic corrosion.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
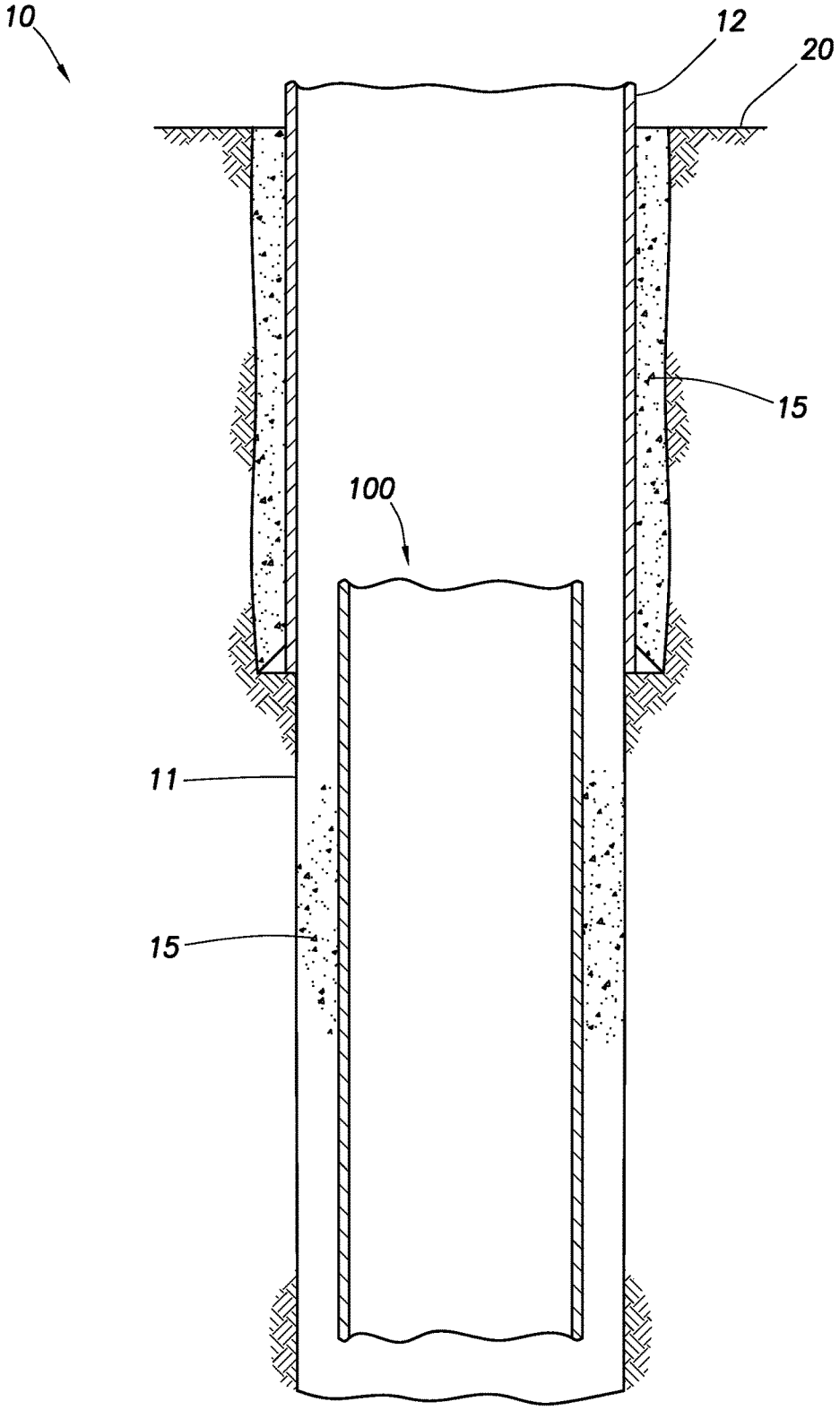
FIG. 1 is a schematic illustration of a well system containing a tool.

As used herein, the words "comprise," "have," "include," and all grammatical variations thereof are each intended to have an open, non-limiting meaning that does not exclude additional elements or steps.

It should be understood that, as used herein, "first," "second," "third," etc., are arbitrarily assigned and are merely intended to differentiate between two or more materials, etc., as the case may be, and does not indicate any particular orientation or sequence. Furthermore, it is to be understood that the mere use of the term "first" does not require that there be any "second," and the mere use of the term "second" does not require that there be any "third," etc.

As used herein, a "fluid" is a substance having a continuous phase that tends to flow and to conform to the outline of its container when the substance is tested at a temperature of 71° F. (22° C.) and a pressure of one atmosphere "atm" (0.1 megapascals "MPa"). A fluid can be a liquid or gas. A homogenous fluid has only one phase; whereas a heterogeneous fluid has more than one distinct phase. A colloid is an example of a heterogeneous fluid. A heterogeneous fluid can be: a slurry, which includes a continuous liquid phase and undissolved solid particles as the dispersed phase; an emulsion, which includes a continuous liquid phase and at least one dispersed phase of immiscible liquid droplets; a foam, which includes a continuous liquid phase and a gas as the dispersed phase; or a mist, which includes a continuous gas phase and a liquid as the dispersed phase.

An example of a heterogeneous fluid is a cement composition. As used herein, a "cement composition" is a mixture of at least cement and water. A cement composition can include additives. As used herein, the term "cement" means an initially dry substance that develops compressive strength or sets in the presence of water. An example of cement is Portland cement. A cement composition is generally a slurry in which the water is the continuous phase of the slurry and the cement (and any other insoluble particles) is the dispersed phase. The continuous phase of a cement composition can include dissolved solids.

Oil and gas hydrocarbons are naturally occurring in some subterranean formations. In the oil and gas industry, a subterranean formation containing oil or gas is referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from a reservoir is called a reservoir fluid.

A well can include, without limitation, an oil, gas, or water production well, or an injection well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a well" means and includes into any portion of the well, including into the wellbore or into the near-wellbore region via the wellbore.

A portion of a wellbore may be an open hole or cased hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

It is desirable to perform treatment operations within a wellbore. A variety of tools can be used to perform the operations. For example, tools can be used to perform fracturing, stimulation, injection, and production operations. Some tools, such as the tools in the RAPIDSUITE™ product line, marketed by Halliburton Energy Services, Inc., are designed to be part of a tubing string in which the tubing string and tools are cemented inside the well. It is not uncommon for these tools to include one or more ports that can be used to transmit a fluid from inside the tool to the outside of the tool, tubing string, or into an annulus or transmit a fluid from outside of the tool to the inside of the tool. These ports can be in an open position, thus allowing fluid flow through the ports. The ports can also be positioned adjacent to a sliding sleeve, wherein movement of the sliding sleeve either opens or closes the ports.

It is common to position a temporary plug within the ports. The plug can prevent fluid flow through the port. In applications where the tubing string and tool is cemented in the wellbore, then the plug can prevent the cement from entering the port from the outside of the tool, whereby the cement could undesirably cement the ports, the sliding sleeve, or any undercuts, for example located between the outside of the sliding sleeve and the inside of an outer mandrel containing the ports. If the cement does enter these spaces, then the sliding sleeve may not be able to be shifted in order to open or close the port or the amount of pressure required to shift the sleeve or un-plug the port may be much greater than anticipated or desired.

However, it is often desirable for the port plugs to be removed after the cement composition has set. The removal of the plugs allows sleeves to be shifted or fluid flow to be restored through the ports. Some of the previous types of removable plugs rely on dissolution of the plug via hydrolysis. However, if sufficient water is not available, then the port plugs will not fully degrade. In addition to an inadequate amount of degradation, a plug can also prematurely degrade. For example, the temperature environment that the tools are generally placed (usually above 180° F.) may be well past the glass transition or melting point of the plug material. This means that the physical properties of the partially degraded plug are weakened so the plugs could be blown out of the ports due to a pressure differential between the inside of the tool and the outside of the tool. Also, a partially degraded plug could allow some cement to penetrate into unwanted areas, causing problems or a higher pressure needed to establish the communication than what was originally intended in the design.

Thus, there is a need for temporary port plugs that can be used to prevent a cement composition from entering undesirable spaces. The port plugs should also be capable of maintaining a specified pressure differential prior to dissolving. The port plugs should also be capable of dissolving in a desired amount of time to establish fluid flow through the ports. It has been discovered that a port plug made of one or two metals or metal alloys can dissolve via corrosion. The rate of corrosion can be adjusted to provide the desired dissolving time of the plug.

As used herein, the term "corrosion" means the dissolution of a metal or metal alloy by a chemical reaction with the environment. An example of corrosion is galvanic corrosion. Galvanic corrosion occurs when two different metals or metal alloys are in electrical connectivity with each other and both are in contact with an electrolyte. As used herein, the phrase "electrical connectivity" means that the two different metals or metal alloys are either touching or in close enough proximity to each other such that when the two different metals are in contact with an electrolyte, the electrolyte becomes electrically conductive and ion migration occurs between one of the metals and the other metal, and is not meant to require an actual physical connection between the two different metals, for example, via a metal wire. Galvanic corrosion can also occur in certain metal alloys when in the presence of an electrolyte without a distinct cathode being present. As used herein, the term "galvanic corrosion" also includes "micro-galvanic corrosion," where the anode and cathode are part of the metal alloy. The term galvanic corrosion is also intended to cover applications where there are distinct regions of anodic and cathodic materials within the metal. It is to be understood that as used herein, the term "metal" is meant to include pure metals and also metal alloys without the need to continually specify that the metal can also be a metal alloy. Moreover, the use of the phrase "metal or metal alloy" in one sentence or paragraph does not mean that the mere use of the word "metal" in another sentence or paragraph is meant to exclude a metal alloy. As used herein, the term "metal alloy" means a mixture of two or more elements, wherein at least one of the elements is a metal. The other element(s) can be a non-metal or a different metal. An example of a metal and non-metal alloy is steel, comprising the metal element iron and the non-metal element carbon. An example of a metal and metal alloy is bronze, comprising the metallic elements copper and tin.

The metal that is less noble, compared to the other metal, will dissolve in the electrolyte. The less noble metal is often referred to as the anode, and the more noble metal is often referred to as the cathode. Galvanic corrosion is an electrochemical process whereby free ions in the electrolyte make the electrolyte electrically conductive, thereby providing a means for ion migration from the anode to the cathode—resulting in deposition formed on the cathode. Metals can be arranged in a galvanic series. The galvanic series lists metals in order of the most noble to the least noble. An anodic index lists the electrochemical voltage (V) that develops between a metal and a standard reference electrode (gold (Au)) in a given electrolyte. The actual electrolyte used can affect where a particular metal or metal alloy appears on the galvanic series and can also affect the electrochemical voltage. For example, the dissolved oxygen content in the electrolyte can dictate where the metal or metal alloy appears on the galvanic series and the metal's electrochemical voltage. The anodic index of gold is −0 V; while the anodic index of beryllium is −1.85 V. A metal that has an anodic index greater than another metal is more noble than the other metal and will function as the cathode. Conversely, the metal that has an anodic index less than another metal is less noble and functions as the anode. In order to determine the relative voltage between two different metals, the anodic index of the lesser noble metal is subtracted from the other metal's anodic index, resulting in a positive value.

There are several factors that can affect the rate of galvanic corrosion. One of the factors is the distance separating the metals on the galvanic series chart or the difference between the anodic indices of the metals. For example, beryllium is one of the last metals listed at the least noble end of the galvanic series and platinum is one of the first metals listed at the most noble end of the series. By contrast, tin is listed directly above lead on the galvanic series. Using the anodic index of metals, the difference between the anodic index of gold and beryllium is 1.85 V; whereas, the difference between tin and lead is 0.05 V. This means that galvanic corrosion will occur at a much faster rate for magnesium or beryllium and gold compared to lead and tin.

The following is a partial galvanic series chart using a deoxygenated sodium chloride water solution as the electrolyte. The metals are listed in descending order from the most noble (cathodic) to the least noble (anodic). The following list is not exhaustive, and one of ordinary skill in the art is able to find where a specific metal or metal alloy is listed on a galvanic series in a given electrolyte.

PLATINUM
GOLD
ZIRCONIUM
GRAPHITE
SILVER
CHROME IRON
SILVER SOLDER
COPPER—NICKEL ALLOY 80-20
COPPER—NICKEL ALLOY 90-10
MANGANESE BRONZE (CA 675), TIN BRONZE (CA903, 905)
COPPER (CA102)
BRASSES
NICKEL (ACTIVE)
TIN
LEAD
ALUMINUM BRONZE
STAINLESS STEEL
CHROME IRON
MILD STEEL (1018), WROUGHT IRON
ALUMINUM 2117, 2017, 2024
CADMIUM
ALUMINUM 5052, 3004, 3003, 1100, 6053
ZINC
MAGNESIUM
BERYLLIUM

The following is a partial anodic index listing the voltage of a listed metal against a standard reference electrode (gold) using a deoxygenated sodium chloride water solution as the electrolyte. The metals are listed in descending order from the greatest voltage (most cathodic) to the least voltage (most anodic). The following list is not exhaustive, and one of ordinary skill in the art is able to find the anodic index of a specific metal or metal alloy in a given electrolyte.

Anodic index

| Metal | Index (V) |
|---|---|
| Gold, solid and plated, Gold-platinum alloy | −0.00 |
| Rhodium plated on silver-plated copper | −0.05 |
| Silver, solid or plated; monel metal. High nickel-copper alloys | −0.15 |
| Nickel, solid or plated, titanium an s alloys, Monel | −0.30 |
| Copper, solid or plated; low brasses or bronzes; silver solder; German silvery high copper-nickel alloys; nickel-chromium alloys | −0.35 |
| Brass and bronzes | −0.40 |
| High brasses and bronzes | −0.45 |
| 18% chromium type corrosion-resistant steels | −0.50 |
| Chromium plated; tin plated; 12% chromium type corrosion-resistant steels | −0.60 |
| Tin-plate; tin-lead solder | −0.65 |
| Lead, solid or plated; high lead alloys | −0.70 |
| 2000 series wrought aluminum | −0.75 |
| Iron, wrought, gray or malleable, plain carbon and low alloy steels | −0.85 |
| Aluminum, wrought alloys other than 2000 series aluminum, cast alloys of the silicon type | −0.90 |
| Aluminum, cast alloys other than silicon type, cadmium, plated and chromate | −0.95 |
| Hot-dip-zinc plate; galvanized steel | −1.20 |
| Zinc, wrought; zinc-base die-casting alloys; zinc plated | −1.25 |
| Magnesium & magnesium-base alloys, cast or wrought | −1.75 |
| Beryllium | −1.85 |

Another factor that can affect the rate of galvanic corrosion is the temperature and concentration of the electrolyte. The higher the temperature and concentration of the electrolyte, generally the faster the rate of corrosion. Yet another factor that can affect the rate of galvanic corrosion is the total amount of surface area of the least noble (anodic metal). The greater the surface area of the anode that can come in contact with the electrolyte, the faster the rate of corrosion. The cross-sectional size of the anodic metal pieces can be decreased in order to increase the total amount of surface area per total volume of the material. The anodic metal or metal alloy can also be a matrix in which pieces of cathode material is embedded in the anode matrix. Yet another factor that can affect the rate of galvanic corrosion is the ambient pressure. Depending on the electrolyte chemistry and the two metals, the corrosion rate can be slower at higher pressures than at lower pressures if gaseous components are generated.

According to an embodiment, a method of performing an operation in a wellbore comprises: introducing a tool into the wellbore, wherein the tool comprises: (A) a mandrel comprising a port; and (B) a plug, wherein the plug is located within the port, and wherein the plug comprises at least a first material, wherein the first material partially or wholly dissolves via corrosion; introducing a cement composition into an annulus located between the outside of the tool at least at the location of the port and the inside of the wellbore; and causing or allowing at least a portion of the first material to dissolve, wherein the step of causing or allowing is performed after the step of introducing the cement composition.

According to another embodiment, a well system comprises: a wellbore, wherein a tubing string is located within the wellbore; a tool, wherein the tool comprises: (A) a mandrel comprising a port; and (B) a plug, wherein the plug is located within the port, and wherein the plug comprises at least a first material, wherein the first material partially or wholly dissolves via corrosion; and a cement composition, wherein the cement composition is located within an annulus between the outside of the tool at least at the location of the port and the inside of the wellbore.

Any discussion of the embodiments regarding the port plug or any component related to the port plug (e.g., the electrolyte) is intended to apply to all of the method embodiments and system embodiments.

Turning to the Figures, FIG. 1 depicts a well system 10. The well system 10 includes at least one wellbore 11. The wellbore 11 can penetrate a subterranean formation 20. The subterranean formation 20 can be a portion of a reservoir or adjacent to a reservoir. The wellbore 11 can include a casing 12. A cement composition 15 can be positioned in an annulus between the outside of the casing 12 and the wall of the wellbore 11. The wellbore 11 can include only a generally vertical wellbore section or can include only a generally horizontal wellbore section. A tool 100 can be installed in the wellbore 11. The tool 100 can be part of a tubing string (not shown), such as a completion string. It should be noted that the well system 10 is illustrated in the drawings and is described herein as merely one example of a wide variety of well systems in which the principles of this disclosure can be utilized. It should be clearly understood that the principles of this disclosure are not limited to any of the details of the well system 10, or components thereof, depicted in the drawings or described herein. Furthermore, the well system 10 can include other components not depicted in the drawing.

The methods include introducing the tool 100 into the wellbore 11. The tool 100 can be any tool that is used in an oil or gas operation where the tubing string and tool are cemented into the wellbore 11. By way of example, the tool 100 can be used for any of the following oil or gas operations, completion operations, stimulation operations (including hydraulic fracturing and acidizing treatments), production operations, or injection operations. An example of a suite of tools that are generally cemented into a tubing string include the RAPIDSUITE™ product line, including the RAPIDFORCE™ sleeve system, RAPIDFRAC™ multistage fracturing system, RAPIDSHIFT™ multistage stimulation and production sleeve system, RAPIDSTAGE™ multistate well stimulation treatment system, RAPIDSTART™ initiator CT sleeve, and the RAPIDSTART™ multistage frac initiator sleeve, all marketed by Halliburton Energy Services, Inc.

Figure 2:
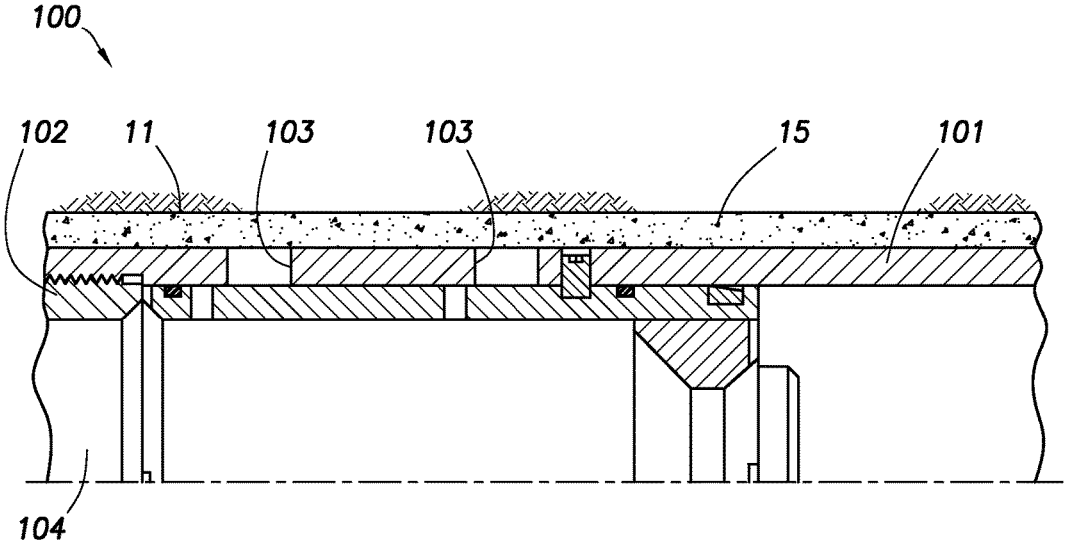
FIG. 2 is a schematic illustration of the tool cemented in a tubing string according to an embodiment.

As can be seen in FIG. 2, the tool 100 includes a mandrel 101 that contains at least one port 103. As used herein, the term "port" means an opening whereby fluids can flow through. The tool 100 can also include two or more ports, wherein a plug is located in some or all of the ports. The tool 100 can also include an inner mandrel 104. The tool 100 can also include a sliding sleeve 102. The sliding sleeve 102 can be used to open or close the port 103. The tool does not have to include a sliding sleeve due to the presence of a plug 105. If the tool includes a sliding sleeve, then the tool can also comprise other components, such as a shear pin or screw, that are commonly used in conjunction with a sliding sleeve.

The well system 10 also includes a cement composition 15, wherein the cement composition 15 is located within an annulus between the outside of the tool 100 at least at the location of the port 103 and the inside of the wellbore 11.

The cement composition 15 can also be located all along the longitudinal length of the outside of the tool and not just at the location of the port. The cement can also be located in an annulus between the outside of the tubing string the tool is part of and the wellbore. The cement composition can also be located some distance on either side of the port. The methods include introducing the cement composition into the annulus. The cement composition 15 can be introduced into the annulus via one or more other annulus ports located on the tool or tubing string (not shown). In this manner, the cement composition 15 can be pumped into the inner mandrel 104, out the annulus ports, and into the annulus.

Figure 3:
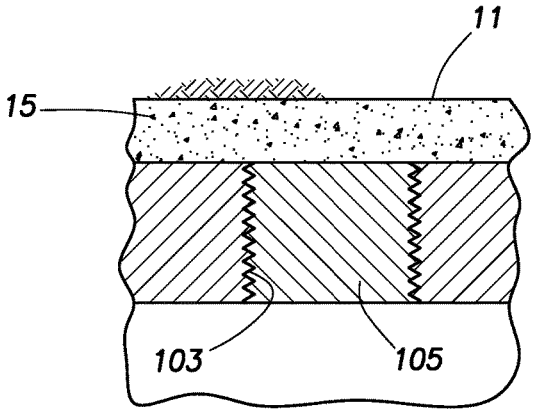
FIG. 3 is a schematic illustration of a port of the tool of FIG. 2 containing a plug.

As can be seen in FIG. 3, the tool 100 also includes the plug 105. The plug 105 is located within the port 103. The plug 105 can be positioned within the port 103 in a variety of ways such that the plug prevents the cement composition 15 from flowing through the port prior to dissolution of all or a portion of the plug. By way of example, the plug 105 can be threadingly inserted into the port 103. The plug could also be wedged; heat shrunk; interference fit; or held into the port with a chemical bonding agent (e.g., a glue). Accordingly, the shape and dimensions of the plug are selected such that the plug fits within the port and forms a seal. According to certain embodiments, the plug 105 is positioned within the port 103 such that the plug can withstand a specified pressure differential across the plug prior to dissolution of the first material. For example, the plug 105 may only need to withstand the pressure exerted on the plug from the cement composition as the cement is being pumped into the annulus. According to this example, the plug may not have to be threaded into the port because the amount of pressure exerted on the plug may not be so great as to require such a threaded connection. According to certain embodiments, the plug 105 prevents the cement composition 15 from flowing from the annulus into any portion of the port 103 or through the port 103 and into any undercuts between the inner mandrel 104 or outside of a sliding sleeve 102 and the outer mandrel 101 prior to dissolution of the first material. An undercut is a space between two objects. The plug can also prevent the cement composition from flowing through the port and bonding to a sliding sleeve.

The plug 105 comprises at least a first material. The plug 105 can further comprise a second material. The first material and the second material are metals or metal alloys. The metals or metal of the metal alloys can be selected from the group consisting of, lithium, sodium, potassium, rubidium, cesium, beryllium, calcium, strontium, barium, radium, aluminum, gallium, indium, tin, thallium, lead, bismuth, scandium, titanium, vanadium, chromium, manganese, thorium, iron, cobalt, nickel, copper, zinc, yttrium, zirconium, niobium, molybdenum, ruthenium, rhodium, palladium, praseodymium, silver, cadmium, lanthanum, hafnium, tantalum, tungsten, terbium, rhenium, osmium, iridium, platinum, gold, neodymium, gadolinium, erbium, oxides of any of the foregoing, graphite, carbon, silicon, boron nitride, and any combinations thereof. Preferably, the metal or metal of the metal alloy is selected from the group consisting of magnesium, aluminum, zinc, beryllium, tin, iron, nickel, copper, oxides of any of the foregoing, and combinations thereof.

At least the first material dissolves via corrosion. The first material can also dissolve via galvanic corrosion when in the presence of an electrolyte. According to certain embodiments, the first material and the second material form a galvanic couple, wherein the first material is the anode and the second material is the cathode of the couple. Stated another way, the second material is more noble than the first material. In this manner, the first material (acting as the anode) partially or wholly dissolves when in electrical connectivity with the second material and when the first and second materials are in contact with an electrolyte. According to this embodiment, the first material and the second material are different metals or metal alloys. By way of example, the first material can be magnesium and the second material can be nickel. As another example, the first material can be magnesium and the second material can be zinc. In another example, the first material can be an aluminum alloy and the second material can be iron. Furthermore, the first material can be a metal and the second material can be a metal alloy. The first material and the second material can be a metal and the first and second material can be a metal alloy.

The plug 105 can contain a nano-composite of the first and second materials. The first and second materials can also be layers of the first and second materials. The first material can also be a matrix and the second material can be particles, nuggets, fibers, etc. dispersed throughout the matrix first material.

The ratio of the first material to the second material can affect the rate of dissolution of the first material. Generally, the higher the concentration of the second material located within the plug, generally the faster the rate of dissolution. Moreover, the second material can be uniformly distributed throughout the matrix of the first material or throughout the plug. This embodiment can be useful when a constant rate of dissolution of the first material is desired. The second material can also be non-uniformly distributed such that different concentrations of the second material are located within different areas of the matrix or plug. By way of example, a higher concentration of nuggets of the second material can be distributed closer to the outside of the plug for allowing an initially faster rate of dissolution; whereas a lower concentration of nuggets can be distributed in the middle and inside of the plug for allowing a slower rate of dissolution. There can also be a variety of patterns of layers of first material and second material for controlling the rate of dissolution of the first material. Of course the concentration of the second material can be distributed in a variety of ways to allow for differing rates of dissolution of the first material.

It has been shown that a metal alloy can dissolve via corrosion. It has also been shown that a metal alloy can dissolve via galvanic corrosion without a distinct cathode being present when the metal alloy is in contact with an electrolyte. Testing has shown that a solid solution, as opposed to a partial solution, of alloying elements can be made to galvanically-corrode in such a way as to be useful as a dissolving first material. One example of a dissolvable metal alloy is a magnesium alloy containing at least 50% by volume of the magnesium metal and another metal or non-metal. Another example of a dissolvable metal alloy is an aluminum alloy containing at least 85% by volume of the aluminum metal. The metal alloy, according to these embodiments, will dissolve via galvanic corrosion when in the presence of a suitable electrolyte.

The first material can partially or wholly dissolves in the presence of an electrolyte when the dissolution is via galvanic corrosion. As used herein, an electrolyte is any substance containing free ions (i.e., a positively or negatively charged atom or group of atoms) that make the substance electrically conductive. The electrolyte can be selected from the group consisting of, solutions of an acid, a base, a salt, and combinations thereof. A cement composition for example can include basic ions. Common free ions in an electrolyte include sodium ($Na^+$), potassium ($K^+$), calcium ($Ca^{2+}$), magnesium ($Mg^{2+}$), chloride ($Cl^-$), hydrogen phosphate ($HPO_4^{2-}$), and hydrogen carbonate ($HCO_3^-$). According to certain embodiments, the electrolyte is the cement composition 15. According to this embodiment, the first material of the plug 105 can start dissolving via galvanic corrosion from the outside of the tool 100 inwards towards the inside of the tool. The electrolyte can also be a fluid that is introduced into the wellbore or a reservoir fluid. For example, a treatment fluid containing the electrolyte can be introduced into the tool, whereby the fluid comes in contact with the plug.

The methods include causing or allowing at least a portion of the first material to dissolve, wherein the step of causing or allowing is performed after the step of introducing the cement composition. The step of causing can include producing a reservoir fluid or pumping a treatment fluid into the tool, wherein the fluid comes in contact with the plug 105. The step of allowing can include allowing the plug 105 to remain in contact with a cement composition 15. The reservoir fluid, the treatment fluid, or the cement composition can also be an electrolyte. At least a portion of the first material can dissolve in a desired amount of time. The desired amount of time can be pre-determined, based in part, on the specific oil or gas operation to be performed. The desired amount of time can be in the range from about 1 hour to about 2 months, preferably about 5 to about 10 days. The desired amount of time can be at least 30 minutes after the cement composition has set within the annulus. As used herein, the term "set" means the process of becoming hard and solid and developing compressive strength through curing.

There are several factors that can affect the rate of dissolution of the first material. According to an embodiment, the first material or the first material and the second material are selected such that the at least a portion of the first material dissolves in the desired amount of time. By way of example, the greater the difference between the second material's anodic index and the first material's anodic index, the faster the rate of dissolution. By contrast, the less the difference between the second material's anodic index and the first material's anodic index, the slower the rate of dissolution. By way of yet another example, the farther apart the first material and the second material are from each other in a galvanic series, the faster the rate of dissolution; and the closer together the first and second material are to each other in the galvanic series, the slower the rate of dissolution. By evaluating the difference in the anodic index of the first and second materials, or by evaluating the order in a galvanic series, one of ordinary skill in the art will be able to determine the rate of dissolution of the first material in a given electrolyte.

Another factor that can affect the rate of dissolution of the first material is the ratio of the first material to the second material. Yet another factor can include the pH of the fluid surrounding the plug 105. For example, magnesium goes into a passivation state when in a fluid having a pH greater than about 11.5. However, aluminum will dissolve in the electrolyte at pH values greater than about 8.5. Therefore, one can select the metal or metal alloy of the first material based on the anticipated pH of the surrounding fluid. Accordingly, one may wish to select metals or metal alloys that dissolve in basic pH ranges if the cement composition is to serve as the electrolyte as most cement compositions have a pH in the basic range.

Another factor that can affect the rate of dissolution of the first material is the concentration of the electrolyte and the temperature of the electrolyte. Generally, the higher the concentration of the electrolyte, the faster the rate of dissolution of the first material, and the lower the concentration of the electrolyte, the slower the rate of dissolution. Moreover, the higher the temperature of the electrolyte, the faster the rate of dissolution of the first material, and the lower the temperature of the electrolyte, the slower the rate of dissolution.

Another factor that can affect the rate of dissolution of the first material is the cross-sectional area of the particles, nuggets, or fibers of the first and second materials. A smaller cross-sectional area increases the ratio of the surface area to total volume of the material, thus allowing more of the material to come in contact with the electrolyte and a faster rate of dissolution.

According to an embodiment, the plug 105 further includes one or more tracers (not shown). The tracer(s) can be, without limitation, radioactive, chemical, electronic, or acoustic. A tracer can be useful in determining real-time information on the rate of dissolution of the first material. By being able to monitor the presence of the tracer, workers at the surface can make on-the-fly decisions that can affect the rate of dissolution of the remaining first material.

The methods can further include opening the port 103. As used herein, the phrase "opening the port," and all grammatical variations thereof means that fluid flow through the port is possible. According to certain embodiments, the dissolution of the first material is sufficient to open the port. According to an embodiment, a sufficient amount of the first material dissolves such that the port is opened. According to other embodiments, the port 103 is opened via shifting of a sliding sleeve 102 and dissolution of the first material of the plug 105. The methods can further include flowing a fluid through the opened port. For example, the methods can further include creating a fracture in the subterranean formation 20 by flowing a fracturing treatment fluid through the opened port. Of course, the exact type of treatment fluid (e.g., a fracturing fluid, injection fluid, reservoir fluid, etc.) that is flowed through the opened port will depend on the specific oil or gas operation being performed. If the plug 105 partially dissolves, then the port can also be opened by creating a higher pressure differential on the outside or inside of the plug. For example, a fracturing treatment fluid is generally pumped at high flow rates and pressures. This high pressure fluid moving through the inside of the tool can encounter the partially dissolved plug and have enough force to push the plug out of the port and create a fracture in the formation. Of course a produced reservoir fluid could push the plug out of the port from the outside of the tool.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of performing an operation in a wellbore comprising:

introducing a tool into the wellbore, wherein the tool comprises:

(A) a mandrel comprising a port; and (B) a plug, wherein the plug is located within the port, and wherein the plug comprises a first material, wherein the first material partially or wholly dissolves via galvanic corrosion within the wellbore, wherein the plug further comprises a second material, wherein the first material and the second material form a galvanic couple, wherein the first material is the anode and the second material is the cathode of the galvanic couple, and wherein the first material dissolves via galvanic corrosion when both the first and second materials are in contact with an electrolyte;

introducing a cement composition into an annulus located between the outside of the tool at least at the location of the port and the inside of the wellbore; and causing or allowing at least a portion of the first material to dissolve, wherein the step of causing or allowing is performed after the step of introducing the cement composition, wherein the cement composition is the electrolyte.

2. The method according to claim 1, wherein the wellbore operation is selected from, completion operations, stimulation operations, production operations, or injection operations.

3. The method according to claim 1, wherein the tool further comprises a sliding sleeve, wherein the sliding sleeve is located adjacent to the port.

4. The method according to claim 3, wherein the port is opened via shifting of the sliding sleeve and the dissolution of the first material of the plug.

5. The method according to claim 1, wherein the plug is threadingly inserted into the port.

6. The method according to claim 1, wherein the shape and dimensions of the plug are selected such that the plug fits within the port and forms a seal.

7. The method according to claim 1, wherein the plug is positioned within the port such that the plug can withstand a specified pressure differential across the plug prior to dissolution of the first material.

8. The method according to claim 1, wherein the plug prevents the cement composition from flowing from the annulus into the port or through the port prior to dissolution of the first material.

9. The method according to claim 1, wherein the first material is a metal alloy.

10. The method according to claim 9, wherein the metal alloy is an aluminum alloy containing at least 85% by volume of aluminum metal.

11. The method according to claim 1, wherein the first material and the second material are metals or metal alloys.

12. The method according to claim 11, wherein the metals or metal of the metal alloys are selected from the group consisting of, lithium, sodium, potassium, rubidium, cesium, beryllium, calcium, strontium, barium, radium, aluminum, gallium, indium, tin, thallium, lead, bismuth, scandium, titanium, vanadium, chromium, manganese, thorium, iron, cobalt, nickel, copper, zinc, yttrium, zirconium, niobium, molybdenum, ruthenium, rhodium, palladium, praseodymium, silver, cadmium, lanthanum, hafnium, tantalum, tungsten, terbium, rhenium, osmium, iridium, platinum, gold, neodymium, gadolinium, erbium, oxides of any of the foregoing, graphite, carbon, silicon, boron nitride, and any combinations thereof.

13. The method according to claim 1, wherein at least a portion of the first material dissolves in a desired amount of time.

14. The method according to claim 13, wherein the desired amount of time is at least 30 minutes after the cement composition has set within the annulus.

15. The method according to claim 1, further comprising opening the port.

16. The method according to claim 15, further comprising flowing a fluid through the opened port.

17. The method according to claim 16, further comprising creating a fracture in a subterranean formation penetrated by the wellbore by flowing a fracturing treatment fluid through the opened port.

18. A well system for use in a wellbore comprising:

a tool, wherein the tool comprises:

(A) a mandrel comprising a port; and (B) a plug, wherein the plug is located within the port, and wherein the plug comprises a first material, wherein the first material partially or wholly dissolves via galvanic corrosion, wherein the plug further comprises a second material, wherein the first material and the second material form a galvanic couple, wherein the first material is the anode and the second material is the cathode of the galvanic couple, and wherein the first material dissolves via galvanic corrosion when both the first and second materials are in contact with an electrolyte; and a cement composition, wherein the cement composition is located within an annulus between the outside of the tool at least at the location of the port and the inside of the wellbore, wherein the cement composition is the electrolyte.

19. The well system according to claim 18, wherein the tool further comprises a sliding sleeve, wherein the sliding sleeve is located adjacent to the port.

20. The well system according to claim 19, wherein the port is configured to open via shifting of the sliding sleeve and the dissolution of the first material of the plug.

* * * * *